US008859471B2

(12) United States Patent
Bush et al.

(10) Patent No.: US 8,859,471 B2
(45) Date of Patent: Oct. 14, 2014

(54) LUBRICANT COMPOSITIONS

(75) Inventors: James H. Bush, Mentor, OH (US); James N. Vinci, Mayfield Hts., OH (US); David Price, Littleover (GB)

(73) Assignee: The Lubrizol Corporation, Wickliffe, OH (US)

( * ) Notice: Subject to any disclaimer, the term of this patent is extended or adjusted under 35 U.S.C. 154(b) by 421 days.

(21) Appl. No.: 12/521,904

(22) PCT Filed: Jan. 24, 2008

(86) PCT No.: PCT/US2008/051872

§ 371 (c)(1), (2), (4) Date: Jan. 18, 2010

(87) PCT Pub. No.: WO2008/094807

PCT Pub. Date: Aug. 7, 2008

(65) Prior Publication Data

US 2010/0144566 A1 Jun. 10, 2010

Related U.S. Application Data

(60) Provisional application No. 60/886,977, filed on Jan. 29, 2007.

(51) Int. Cl.

| | |
|---|---|
| ***C10M 163/00*** | (2006.01) |
| ***C10M 173/00*** | (2006.01) |
| ***C10M 105/38*** | (2006.01) |
| ***C10M 107/34*** | (2006.01) |
| ***C10M 157/00*** | (2006.01) |
| ***C10M 169/04*** | (2006.01) |

(52) U.S. Cl.

CPC ..... *C10M 169/04* (2013.01); *C10N 2240/042* (2013.01); *C10M 2205/04* (2013.01); *C10N 2240/04* (2013.01); *C10M 107/34* (2013.01); *C10M 2209/1033* (2013.01); *C10M 2223/045* (2013.01); *C10N 2240/044* (2013.01); *C10M 2209/084* (2013.01); *C10M 2223/04* (2013.01); *C10M 2223/042* (2013.01); *C10M 157/00* (2013.01); *C10M 2219/022* (2013.01); *C10N 2240/046* (2013.01); *C10N 2230/06* (2013.01); *C10N 2240/045* (2013.01); *C10M 2209/1075* (2013.01); *C10M 2205/02* (2013.01); *C10M 2223/043* (2013.01); *C10M 2209/1045* (2013.01); *C10M 2209/1055* (2013.01)

USPC ..... 508/185; 508/315; 508/485

(58) Field of Classification Search

USPC ..... 508/185, 315, 485

See application file for complete search history.

(56) References Cited

U.S. PATENT DOCUMENTS

| | | | | |
|---|---|---|---|---|
| 3,527,726 | A | 9/1970 | Gower et al. | |
| 4,370,247 | A | 1/1983 | Ostyn | |
| 5,342,531 | A * | 8/1994 | Walters et al. | 508/272 |
| 6,544,935 | B1 * | 4/2003 | Vargo et al. | 508/232 |
| 2004/0092409 | A1 * | 5/2004 | Liesen | 508/469 |
| 2004/0198616 | A1 * | 10/2004 | Hirao et al. | 508/485 |
| 2006/0025316 | A1 * | 2/2006 | Covitch et al. | 508/459 |

FOREIGN PATENT DOCUMENTS

| | | |
|---|---|---|
| EP | 0460317 B1 | 10/1993 |
| EP | 0377122 B1 | 6/1995 |

OTHER PUBLICATIONS

Corresponding PCT Publication No. WO 2008/094807 A2 published Aug. 7, 2008.

Corresponding PCT Search Report Publication No. WO 2008/094807 A3 published Mar. 26, 2009.

* cited by examiner

*Primary Examiner* — Prem C Singh

*Assistant Examiner* — Francis C Campanell

(74) *Attorney, Agent, or Firm* — Michael F. Esposito, Esq.; David M. Shold, Esq.

(57) ABSTRACT

The present invention relates to a lubricating composition containing (a) an ester-containing viscosity index improver; and (b) a polyoxyalkylene polyol. The invention further provides a method for lubricating a mechanical device with the lubricating composition.

12 Claims, No Drawings

LUBRICANT COMPOSITIONS

FIELD OF INVENTION

The present invention relates to a lubricating composition comprising (a) an ester-containing viscosity index improver; and (b) a polyoxyalkylene polyol. The invention further provides a method for lubricating a mechanical device with the lubricating composition.

BACKGROUND OF THE INVENTION

It is known to lubricate mechanical devices such as driveline power transmitting devices, internal combustion engines or hydraulic systems with a lubricant comprising a polyoxyalkylene polyol oil of lubricating viscosity. However, due to the polarity of polyalkylene glycol fluids, difficulties have arisen utilising fully formulated lubricants, for instance the ability to prepare multi-grade lubricants.

In addition driveline power transmitting devices such as gears or transmissions, especially axle fluids and manual transmission fluids (MTFs), present highly challenging technological problems and solutions for satisfying the multiple and often conflicting lubricating requirements, whilst providing at least one of wear performance, durability and fuel economy. One of the important parameters influencing performance is lubricant viscosity and whether mono-grade or multi-grade lubricant fluids are useful for control of low temperature viscometrics and/or high temperature viscometrics. Lubricants capable of performing at lower viscosity typically provide increased fuel economy (thus improving CAFÉ efficiency). Conversely, lower viscosity fluids also contribute to elevated gear and transmission operating temperatures, which are believed to reduce fuel economy. Additionally, increasing lubricant viscosity is believed to provide better wear protection and durability to gears and transmissions.

Consequently, it would be desirable to provide a correctly balanced lubricant composition to meet the needs of mechanical devices such as gears and transmissions.

The lubricating composition of the invention is capable of imparting at least one of acceptable low temperature viscometrics, acceptable high temperature viscometrics, viscosity index (VI), oil blend thickening capabilities, shear stability, an acceptable co-efficient of friction, reduced operating temperatures, acceptable wear performance, acceptable corrosion, acceptable oxidative degradation, acceptable durability, or acceptable fuel economy.

U.S. Pat. No. 4,370,247 and European Patent Application 460 317 disclose polyalkylene glycol lubricating compositions.

U.S. Pat. No. 4,370,247 discloses the use of a polyalkylene glycol to reduce power loss due to a frictional decrease.

European Patent Application 460 317 discloses gear oil a lubricating composition containing a polyalkylene glycol lubricant and at least one sulphur-containing antiwear or extreme pressure agent. The gear oil lubricating composition does not include viscosity modifiers.

SUMMARY OF THE INVENTION

In one embodiment the invention provides a lubricating composition comprising: (a) an ester-containing viscosity index improver; and (b) about 30 wt % or more of a polyoxyalkylene polyol.

In one embodiment the ester-containing viscosity index improver is derived from at least one (a) a polymethacrylate, (b) a copolymer of (i) a vinyl aromatic monomer; and (ii) an unsaturated carboxylic acid, anhydride, or derivatives thereof, (c) an interpolymer of (i) an alpha-olefin; and (ii) an unsaturated carboxylic acid, anhydride, or derivatives thereof, or (d) mixtures thereof.

In one embodiment the invention provides the lubricating compositions disclosed herein in the form of a concentrate.

In one embodiment the invention provides the lubricating compositions disclosed herein in the form of a fully formulated lubricant.

In one embodiment the invention provides a method of lubricating a mechanical device by supplying to the mechanical device a lubricating composition comprising (a) an ester-containing viscosity index improver; and (b) about 30 wt % or more of a polyoxyalkylene polyol.

In one embodiment the mechanical device includes a driveline device.

In one embodiment the lubricating composition further comprises a phosphorus-containing acid, salt or ester, or mixtures thereof.

In one embodiment the lubricating composition further comprises a non-phosphorus extreme pressure agent, or mixtures thereof.

In one embodiment the invention provides a lubricating composition comprising:

(a) about 1.5 wt % to about 30 wt % of an ester-containing viscosity index improver;

(b) about 55 wt % to about 98.29 wt % of a polyoxyalkylene polyol;

(c) about 0.1 wt % to about 5 wt % of a phosphorus-containing acid, salt or ester;

(d) about 0.1 wt % to about 5 wt % of a non-phosphorus extreme pressure agent; and (e) about 0.01 wt % to about 5 wt % of at least one other performance additive.

In one embodiment the invention provides the use of a lubricating composition disclosed herein in a driveline device.

DETAILED DESCRIPTION OF THE INVENTION

As disclosed herein, the present invention provides a lubricating composition; and a method of lubricating a mechanical device with the lubricating composition disclosed herein.

Ester-Containing Viscosity Index Improver

In one embodiment the ester-containing viscosity index improver derived from at least one (a) a polymethacrylate, (b) a copolymer (typically an interpolymer) of (i) a vinyl aromatic monomer; and (ii) an unsaturated carboxylic acid, anhydride, or derivatives thereof, (c) an interpolymer of (i) an alpha-olefin; and (ii) an unsaturated carboxylic acid, anhydride, or derivatives thereof, or (d) mixtures thereof. The copolymer or interpolymer are typically esterified by reacting the carboxylic acid groups or anhydride groups with an appropriate chain-length alcohol, optionally in the presence of a known esterification catalyst.

In one embodiment the ester-containing viscosity index improver derived from a polymethacrylate. The polymethacrylate typically contains an alkyl ester group. The ester group may be linear or branched. In one embodiment the alkyl ester group is linear. In one embodiment the alkyl ester group is branched.

In one embodiment the ester group is branched, the percent of branching includes ranges of 10% to about 65%, or about 15% to about 30%.

In different embodiments the ester alkyl group contains about 6 or more, or about 6 to about 18, or about 8 to about 14 carbon atoms.

In one embodiment the ester groups may contain alkyl groups outside the carbon changes lengths quoted above, with the proviso that the average number of carbon atoms on the ester groups is within the ranges disclosed.

Examples of a suitable methacrylate monomer capable of forming the polymethacrylate include methyl methacrylate, ethyl methacrylate, propyl methacrylate, butyl methacrylate, hexyl methacrylate, octyl methacrylate, 2-ethylhexyl methacrylate, decyl methacrylate, undecyl methacrylate, dodecyl methacrylate, tridecyl methacrylate, tetradecyl methacrylate, pentadecyl methacrylate, hexadecyl methacrylate, or mixtures thereof.

In one embodiment the unsaturated carboxylic acid, anhydride or derivatives thereof, include acrylic acid, methacrylic acid, butenoic acid, maleic acid, maleic anhydride, fumaric acid, itaconic acid, or mixtures thereof. In one embodiment the unsaturated carboxylic acid or derivatives thereof includes maleic acid, maleic anhydride, fumaric acid, itaconic acid, or mixtures thereof. In one embodiment the unsaturated carboxylic acid or derivatives thereof includes maleic acid or maleic anhydride.

In one embodiment the ester-containing viscosity index improver derived from a copolymer of (i) a vinyl aromatic monomer; and (ii) an unsaturated carboxylic acid, anhydride, or derivatives thereof. In one embodiment the viscosity index improver is derived from an interpolymer of (i) a vinyl aromatic monomer; and (ii) an unsaturated carboxylic acid, anhydride, or derivatives thereof. In one embodiment the ester-containing viscosity modifier includes an esterified maleic anhydride-styrene copolymer.

Examples of a vinyl aromatic monomer include styrene (often referred to as ethenylbenzene), substituted styrene or mixtures thereof. Substituted styrene monomers include functional groups such as a hydrocarbyl group, halo-, amino-, alkoxy-, carboxy-, hydroxy-, sulphonyl- or mixtures thereof. The functional groups include those located at the ortho, meta or para positions relative to the vinyl group on the aromatic monomer, the functional groups are located at the ortho or para position being especially useful. In one embodiment the functional groups are located at the para position. Halo-functional groups include chlorine, bromine, iodine or mixtures thereof. In one embodiment the halo functional group is chlorine or mixtures thereof. Alkoxy functional groups may contain about 1 to about 10 carbon atoms, or about 1 to about 8 carbon atoms, or about 1 to about 6 carbon atoms, or about 1 to about 4 carbon atoms. Alkoxy functional groups containing 1 to about 4 carbon atoms is referred to as lower alkoxy styrene.

Examples of a vinyl aromatic monomer include styrene, alpha-methylstyrene, para-methylstyrene (often referred to as vinyl toluene), para-tert-butylstyrene, alpha-ethylstyrene, para-lower alkoxy styrene or mixtures thereof. In one embodiment, the vinyl aromatic monomer is styrene.

In one embodiment the ester-containing viscosity index improver derived from an interpolymer of (i) an alpha-olefin; and (ii) an unsaturated carboxylic acid, anhydride, or derivatives thereof. In one embodiment the interpolymer of (i) an alpha-olefin; and (ii) an unsaturated carboxylic acid, anhydride, or derivatives thereof is a diester.

In one embodiment the copolymer derived from an unsaturated carboxylic acid, anhydride, or derivatives thereof includes an interpolymer of (i) an alpha-olefin typically having at least about 6 carbon atoms; and (ii) an unsaturated carboxylic acid, anhydride, or derivatives thereof.

The alpha-olefin typically contains at least about 6 carbon atoms, or at least about 10 carbon atoms. In one embodiment the alpha-olefin contains about 10 to about 30 carbon atoms. Examples of a suitable alpha-olefin include 1-hexene, 1-heptene, 1-octene, 2-methyl-1-heptene, 1-nonene, 1-decene, 1-dodecene, 1-tetradecene, 1-hexadecene, 1-octadecene and 1-eicosene, or mixtures thereof.

A more detailed description of the interpolymer of (i) an alpha-olefin having at least about 6 carbon atoms; and (ii) an unsaturated carboxylic acid, anhydride, or derivatives thereof, is described in U.S. Pat. No. 4,526,950.

Typically the viscosity index improver such as (b) and (c) above, i.e., (b) a copolymer (typically an interpolymer) of (i) a vinyl aromatic monomer; and (ii) an unsaturated carboxylic acid, anhydride, or derivatives thereof, (c) an interpolymer of (i) an alpha-olefin; and (ii) an unsaturated carboxylic acid, anhydride, or derivatives thereof are esterified by reacting the unsaturated carboxylic acid with an alcohol.

The ester group of the ester-containing viscosity index improver in different embodiments contains about 6 or more, or about 6 to about 18, or about 8 to about 14 carbon atoms.

As described hereinafter the molecular weight of the ester-containing viscosity index improver has been determined using known methods, such as GPC analysis using polystyrene standards. Methods for determining molecular weights of polymers are well known. The methods are described for instance: (i) P. J. Flory, "Principles of Polymer Chemistry", Cornell University Press, 1953), Chapter VII, pp 266-315; or (ii) "Macromolecules, an Introduction to Polymer Science", F. A. Bovey and F. H. Winslow, Editors, Academic Press (1979), pp 296-312.

In different embodiment the weight average molecular weight of the viscosity index improver (such as the polymethacrylate or the an interpolymer of (i) an alpha-olefin; and (ii) an unsaturated carboxylic acid, anhydride, or derivatives thereof) may be in a range including about 8,000 to about 150,000, or about 10,000 to about 100,000 or about 15,000 to about 75,000, or about 25,000 to about 70,000.

The molecular weight of the ester-containing viscosity index improver derived from (i) a vinyl aromatic monomer; and (ii) an unsaturated carboxylic acid, anhydride, or derivatives thereof may also be expressed in terms of the "reduced specific viscosity" of the polymer which is recognised means of expressing the molecular size of a polymeric substance. As used herein, the reduced specific viscosity (abbreviated as RSV) is the value obtained in accordance with the formula RSV=(Relative Viscosity−1)/Concentration, wherein the relative viscosity is determined by measuring, by means of a dilution viscometer, the viscosity of a solution of about 1 g of the polymer in about 10 $cm^3$ of acetone and the viscosity of acetone at about 30° C. For purpose of computation by the above formula, the concentration is adjusted to about 0.4 g of the interpolymer per about 10 $cm^3$ of acetone. A more detailed discussion of the reduced specific viscosity, also known as the specific viscosity, as well as its relationship to the average molecular weight of an interpolymer, appears in Paul J. Flory, Principles of Polymer Chemistry, (1953 Edition) pages 308 et seq. In different embodiments, the viscosity index improver (such as the interpolymer) has a RSV at a range selected from the group consisting of about 0.05 to about 2, about 0.06 to about 1, and about 0.06 to about 0.8. In one embodiment the RSV is about 0.69. In another embodiment the RSV is about 0.12. In one embodiment the Mw (weight average molecular weight) of the viscosity index improver is about 10,000 to about 300,000.

In one embodiment the ester-containing viscosity index improver is present in the lubricating composition at a range selected from the group consisting of about 0.1 wt % to about 70 wt %, or about 0.5 wt % to about 64.97 wt %, or about 1 wt % to about 59.79 wt %, or about 1.25 wt % to about 49.79 wt %, and about 1.5 wt % to about 30 wt %, of the lubricating composition.

Polyoxyalkylene Polyol

The polyoxyalkylene polyol of the invention is known. In one embodiment the polyoxyalkylene polyol is utilised as primarily or exclusively as an oil of lubricating viscosity.

In one embodiment the polyoxyalkylene polyol is present in the lubricating composition at a range selected from the group consisting of about 30 wt % to about 99.9 wt %, about 35 wt % to about 99.38 wt %, or about 40 wt % to about 98.79 wt %, or about 50 wt % to about 98.54 wt %, and about 55 wt % to about 98.29 wt %, of the lubricating composition.

In one embodiment the polyoxyalkylene polyol has a weight average molecular weight of about 200 to about 50,000, or about 500 to about 20,000, or about 750 to about 10,000, or about 1000 to about 5000.

In one embodiment the polyoxyalkylene polyol includes a homopolymer or a copolymer of an alkylene oxide.

In one embodiment the polyoxyalkylene polyol is a copolymer and may be random or block. In one embodiment the copolymer is block. In one embodiment the copolymer is random.

In one embodiment the polyoxyalkylene polyol is a homopolymer or a copolymer obtained/obtainable from an alkylene oxide including ethylene oxide, propylene oxide, butylene oxide, pentylene oxide, hexylene oxide, heptylene oxide, octylene oxide, nonylene oxide, decylene oxide, undecylene oxide, dodecylene oxide, tridecylene oxide, tetradecylene, pentadecylene oxide, hexadecylene oxide, heptadecylene oxide, octadecylene oxide, nonadecylene oxide, eicosylene oxide, or mixtures thereof.

In one embodiment the polyoxyalkylene polyol is copolymer obtained/obtainable from a mixture of (1) at least one alkylene oxide selected from the group consisting of ethylene oxide, propylene oxide, butylene oxide, pentylene oxide, hexylene oxide, heptylene oxide, and mixtures thereof; and (2) at least one alkylene oxide selected from the group consisting of octylene oxide, nonylene oxide, decylene oxide, undecylene oxide, dodecylene oxide, tridecylene oxide, tetradecylene, pentadecylene oxide, hexadecylene oxide, heptadecylene oxide, octadecylene oxide, nonadecylene oxide, eicosylene oxide, and mixtures thereof.

In one embodiment the alkylene oxide of (2) is selected from the group consisting of decylene oxide, undecylene oxide, dodecylene oxide, tridecylene oxide, tetradecylene, pentadecylene oxide, hexadecylene oxide, heptadecylene oxide, octadecylene oxide, and mixtures thereof.

In one embodiment the polyoxyalkylene polyol is obtained/obtainable from a copolymer of two or more alkylene oxides.

In one embodiment the polyoxyalkylene polyol comprises (i) a portion of oxyalkylene groups derived from ethylene oxide; and (ii) a portion of oxyalkylene groups derived from an alkylene oxide containing about 3 to about 8 carbon atoms.

In one embodiment the polyoxyalkylene polyol is obtained/obtainable from a copolymer of ethylene oxide and propylene oxide.

In one embodiment the polyoxyalkylene polyol comprises (i) about 0.1 wt % to about 80 wt % of ethylene oxide, and an alkylene oxide containing about 3 to about 8 carbon atoms present at about 20 wt % to about 99.9 wt % of the polyoxyalkylene polyol.

In one embodiment the polyoxyalkylene polyol comprises (i) about 0 wt % to about 75 wt % of ethylene oxide, and an alkylene oxide containing about 3 to about 8 carbon atoms present at about 25 wt % to about 100 wt % of the polyoxyalkylene polyol.

In one embodiment the polyoxyalkylene polyol comprises (i) about 1 wt % to about 70 wt % of ethylene oxide, and an alkylene oxide containing about 3 to about 8 carbon atoms present at about 30 wt % to about 99 wt % of the polyoxyalkylene polyol.

In one embodiment the polyoxyalkylene polyol comprises (i) about 5 wt % to about 60 wt % of ethylene oxide, and an alkylene oxide containing about 3 to about 8 carbon atoms present at about 40 wt % to about 95 wt % of the polyoxyalkylene polyol.

Examples of suitable commercially available polyoxyalkylene polyol compounds include Actaclear™ ND-21 available from Bayer, Emkarox® VG-222, Emkarox® VG-127W, Emkarox® VG-132W (all Emkarox products available from Uniquema), or various oil-soluble Synalox® or Pluracol® products available from BASF.

In one embodiment the polyoxyalkylene polyol is obtained/obtainable from a copolymer of (i) one or more alkylene oxides, and (ii) styrene oxide.

In one embodiment the polyoxyalkylene polyol includes a polyoxyalkylene polyol, a mono- or di-hydrocarbyl-capped polyoxyalkylene polyol (herein generally referred to as a hydrocarbyl-capped polyalkylene polyol), or mixtures thereof.

In one embodiment the hydroxyl-capped polyoxyalkylene polyol is obtained/obtainable by a process that comprises reacting (i) an alkylene oxide, (ii) water and optionally an alcohol, and (iii) a base catalyst, by a process known to a person skilled in the art.

The hydrocarbyl-capped polyoxyalkylene polyol may be prepared by basic catalysis. U.S. Pat. Nos. 4,274,837, 4,877,416, and 5,600,025 disclose the use of alkali metals such as potassium as a basic catalyst for making hydrocarbyl-capped polyoxyalkylene polyol.

In one embodiment the hydrocarbyl-capped polyoxyalkylene polyol may be prepared using a double metal cyanide catalyst. Suitable double cyanide catalysts are described in U.S. Pat. Nos. 3,278,457, 3,941,849, 4,472,560, 5,158,922, 5,470,813, and 5,482,908.

Examples of a suitable base catalyst include alkaline-metal hydroxides, alkaline earth-metal hydroxides, Lewis bases, and double metal-cyanide complexes.

In one embodiment the polyoxyalkylene polyol may be prepared using a zinc hexacyanocobaltate-tert-butyl alcohol complex as disclosed in U.S. Pat. No. 6,821,308.

The reaction may be carried out a reaction temperature range of about 50° C. to about 150° C., or about 100° C. to about 120° C.

The reaction may be carried out at atmospheric pressure between about 10 kPa to about 3000 kPa (or about 0.1 bar to about 30 bar), or about 50 kPa to about 1500 kPa (or about 0.5 bar to about 15 bar).

The base catalyst may be removed or neutralised by techniques including acid neutralization, ion exchange, adsorption of metals, or mixtures thereof.

The initiator is typically water and/or an alcohol. The alcohol includes either a monohydric alcohol or a polyhydric alcohol. Examples of a suitable polyhydric alcohol include ethylene glycol, propylene glycol, 1,3-butylene glycol, 2,3-butylene glycol, 1,5-pentane diol, 1,6-hexane diol, glycerol, sorbitol, pentaerythritol, trimethylolpropane, starch, glucose, sucrose, methylglucoside, or mixtures thereof. Examples of a monohydric alcohol include methanol, ethanol, propanol, butanol, pentanol, hexanol, heptanol, octanol, 2-ethylhexanol, nonanol, decanol, undecanol, dodecanol, tridecanol, tetradecanol, pentadccanol, hexadecanoyl, heptadecanol, octadccanol, nonadccanol, cicosanol, or mixtures thereof.

In different embodiments linear monohydric alcohol includes methanol, butanol, or mixtures thereof.

In one embodiment the monohydric alcohol is linear and contains about 1 to about 40 carbon atoms. In one embodiment the monohydric alcohol is branched and contains about 1 to about 60 carbon atoms.

In one embodiment the monohydric alcohol is linear and contains about 11 to about 40 carbon atoms.

In one embodiment the monohydric alcohol is branched and contains about 6 to about 40 carbon atoms.

In different embodiments a suitable linear monohydric alcohol includes mixtures of $C_{12-15}$ alcohol, or $C_{8-10}$ alcohols, In one embodiment branched monohydric alcohols include 2-ethylhexanol, or isotridecanol, Guerbet alcohols, or branched alcohols of the Formula $R'R''CHCH_2OH$, or mixtures thereof.

Examples of suitable groups for R' and R" on the formula defined above include the following:

1) alkyl groups containing $C_{15-16}$ polymethylene groups, such as 2-$C_{1-15}$ alkyl-hexadecyl groups (e.g. 2-octylhexadecyl) and 2-alkyl-octadecyl groups (e.g. 2-ethyloctadecyl, 2-tetradecyl-octadecyl and 2-hexadecyloctadecyl);

2) alkyl groups containing $C_{13-14}$polymethylene group, such as 2-$C_{1-15}$ alkyl-tetradecyl groups (e.g. 2-hexyltetradecyl, 2-decyltetradecyl and 2-undecyltridecyl) and 2-$C_{1-15}$alkyl-hexadecyl groups (e.g. 2-ethyl-hexadecyl and 2-dodecylhexadecyl);

3) alkyl groups containing $C_{10-12}$polymethylene group, such as 2-$C_{1-15}$ alkyl-dodecyl groups (e.g. 2-octyldodecyl) and 2-$C_{1-15}$alkyl-dodecyl groups (2-hexyldodecyl and 2-octyldodecyl), 2-$C_{1-15}$alkyl-tetradecyl groups (e.g. 2-hexyltetradecyl and 2-decyltetradecyl);

4) alkyl groups containing $C_{6-9}$polymethylene group, such as 2-$C_{1-15}$ alkyl-decyl groups (e.g. 2-octyldecyl and 2,4-di-$C_{1-15}$ alkyl-decyl groups (e.g. 2-ethyl-4-butyl-decyl group);

5) alkyl groups containing $C_{1-5}$polymethylene group, such as 2-(3-methylhexyl)-7-methyl-decyl and 2-(1,4,4-trimethylbutyl)-5,7,7-trimethyl-octyl groups; and 6) and mixtures of two or more branched alkyl groups, such as alkyl residues of oxoalcohols corresponding to propylene oligomers (from hexamer to undecamer), ethylene/propylene (molar ratio of about 16:1-1:11) oligomers, iso-butene oligomers (from pentamer to octamer), $C_{5-17}$ α-olefin oligomers (from dimer to hexamer).

In one embodiment the hydrocarbyl-capped polyoxyalkylene polyol in mono-capped.

The monohydric alcohol typically forms a capping group on the hydrocarbyl-capped polyoxyalkylene polyol.

In different embodiments the hydrocarbyl-capped group of the polyoxyalkylene polyol comprises a residue of a linear or branched monohydric alcohol containing about 6 to about 40, or about 6 to about 30, or about 8 to about 20 carbon atoms.

In different embodiments the hydrocarbyl-capped group of the polyoxyalkylene polyol comprises a residue of a branched monohydric alcohol containing about 6 to about 60, or about 8 to about 50, or about 8 to about 30, or about 8 to about 12 carbon atoms. The branching may occur at any point in the chain and the branching may be of any length.

Examples of a branched monohydric alcohol containing about 6 or more carbon atoms include 2-ethylhexanol In different embodiments the hydrocarbyl-capped group of the polyoxyalkylene polyol comprises a residue of a linear monohydric alcohol containing about 1 to about 60, or 11 to about 60, or about 11 to about 30, or about 12 to about 20, or about 12 to about 18 carbon atoms.

Phosphorus-Containing Acid, Salt or Ester

In one embodiment the lubricating composition includes a phosphorus-containing acid, salt or ester. The phosphorus-containing acid, salt or ester may be an antiwear agent and/or an extreme pressure agent. In one embodiment the phosphorus-containing acid, salt or ester is in the form of a mixture.

The phosphorus-containing acid, salt or ester may be ash-containing (i.e. metal containing) or ashless (i.e. metal free (prior to being mixed with other components)).

The phosphorus-containing acid, salt or ester includes (i) a non-ionic phosphorus compound; (ii) an amine salt of a phosphorus compound (such as an amine salt of a mixture of monoalkyl and dialkyl phosphoric acid esters); (iii) an ammonium salt of a phosphorus compound; (iv) a mono- or divalent metal salt of a phosphorus compound, such as a metal dialkyldithiophosphate or a metal dialkylphosphate; or (v) mixtures of two or more of (i), (ii), (iii) or (iv).

In one embodiment the phosphorus-containing acid, salt or ester includes a metal dialkyldithiophosphate. The alkyl groups of the dialkyldithiophosphate include linear or branched containing about 2 to about 20 carbon atoms, provided that the total number of carbons is sufficient to make the metal dialkyldithiophosphate soluble in the hydrocarbyl-capped group of the polyoxyalkylene polyol. The metal of the metal dialkyldithiophosphate typically includes monovalent or divalent metals. Examples of suitable metals include sodium, potassium, copper, calcium, magnesium, barium or zinc. In one embodiment the phosphorus-containing acid, salt or ester is a zinc dialkyldithiophosphate. Examples of a suitable zinc dialkylphosphate often referred to as ZDDP, ZDP or ZDTP) include, zinc di-(amyl) dithiophosphate, zinc di-(1,3-dimethylbutyl)dithiophosphate, zinc di-(heptyl)dithiophosphate, zinc di-(octyl)dithiophosphate di-(2-ethylhexyl) dithiophosphate, zinc di-(nonyl)dithiophosphate, zinc di-(decyl)dithiophosphate, zinc di-(dodecyl)dithiophosphate, zinc di-(dodecylphenyl)dithiophosphate, zinc di-(heptylphenyl)dithiophosphate, or mixtures thereof.

Examples of a zinc dialkyldithiophosphate derived from mixtures of alcohols include those derived from (i) a mixture of amyl alcohol and isobutyl alcohol, (ii) 2-ethylhexyl alcohol and isopropyl alcohol, and (iii) 4-methyl-2-pentanol and isopropyl alcohol.

In one embodiment the phosphorus-containing acid, salt or ester is other than metal dialkyldithiophosphate.

In one embodiment the phosphorus-containing acid, salt or ester includes an ammonium or amine salt of a phosphorus-containing acid or ester.

The amine salt of a phosphorus acid or ester includes phosphoric acid esters and amine salts thereof; dialkyldithiophosphoric acid esters and amine salts thereof; amine salts of phosphites; and amine salts of phosphorus-containing carboxylic esters, ethers, and amides; and mixtures thereof.

The amine salt of a phosphorus acid or ester may be used alone or in combination. In one embodiment the amine salt of a phosphorus compound is derived from an amine salt of a phosphorus compound, or mixtures thereof.

In one embodiment the amine salt of a phosphorus acid or ester includes a partial amine salt-partial metal salt compounds or mixtures thereof. In one embodiment the amine salt of a phosphorus acid or ester further includes at least one sulphur atom in the molecule.

Suitable amines that are suitable for making the amine salt include primary amines, secondary amines, tertiary amines, and mixtures thereof. The amines include those with at least one hydrocarbyl group, or, in certain embodiments, two or three hydrocarbyl groups. The hydrocarbyl groups may contain about 2 to about 30 carbon atoms, or in other embodiments about 8 to about 26, or about 10 to about 20, or about 13 to about 19 carbon atoms.

Primary amines include ethylamine, propylamine, butylamine, 2-ethylhexylamine, octylamine, and dodecylamine, as well as such fatty amines as n-octylamine, n-decylamine, n-dodecylamine, n-tetradecylamine, n-hexadecylamine, n-octadecylamine and oleyamine. Other useful fatty amines include commercially available fatty amines such as "Armeen®" amines (products available from Akzo Chemicals, Chicago, Ill.), such as Armeen C, Armeen O, Armeen OL, Armeen T, Armeen HT, Armeen S and Armeen SD, wherein the letter designation relates to the fatty group, such as coco, oleyl, tallow, or stearyl groups.

Examples of suitable secondary amines include dimethylamine, diethylamine, dipropylamine, dibutylamine, diamylamine, dihexylamine, diheptylamine, methylethylamine, ethylbutylamine and ethylamylamine. The secondary amines include cyclic amines such as piperidine, piperazine and morpholine.

In one embodiment the amine includes a tertiary-aliphatic primary amine. The aliphatic group of the tertiary-aliphatic primary amine includes an alkyl group containing about 2 to about 30, or about 6 to about 26, or about 8 to about 24 carbon atoms. Tertiary alkyl amines include monoamines such as tert-butylamine, tert-hexylamine, 1-methyl-1-amino-cyclohexane, tert-octylamine, tert-decylamine, tertdodecylamine, tert-tetradecylamine, tert-hexadecylamine, tert-octadecylamine, tert-tetracosanylamine, and tert-octacosanylamine.

In one embodiment the amine salt of a phosphorus acid or ester includes an amine with about C11 to about C14 tertiary alkyl primary groups or mixtures thereof. In one embodiment the amine salt of a phosphorus compound includes an amine with about C14 to about C18 tertiary alkyl primary amines or mixtures thereof. In one embodiment the amine salt of a phosphorus compound includes an amine with about C18 to about C22 tertiary alkyl primary amines or mixtures thereof.

Mixtures of amines may also be used in the invention. In one embodiment a useful mixture of amines is "Primene® 81R" and "Primene® JMT." Primene® 81R or Primene® JMT (both produced and sold by Rohm & Haas) are mixtures of about C11 to about C14 tertiary alkyl primary amines and about C18 to about C22 tertiary alkyl primary amines respectively.

In one embodiment the amine salt of a phosphorus acid or ester is the reaction product of a about C14 to about C18 alkylated phosphoric acid with Primene 81R® (produced and sold by Rohm & Haas) which is a mixture of about C11 to about C14 tertiary alkyl primary amines.

Examples of the amine salt of a phosphorus acid or ester include the reaction product(s) of isopropyl, methyl-amyl (4-methyl-2-pentyl or mixtures thereof), 2-ethylhexyl, heptyl, octyl or nonyl dithiophosphoric acids with ethylene diamine, morpholine, or Primene 81R™, and mixtures thereof.

In one embodiment a dithiophosphoric acid may be reacted with an epoxide or a glycol. This reaction product is further reacted with a phosphorus acid, anhydride, or lower ester (where "lower" signifies about 1 to about 8, or about 1 to about 6, or about 1 to about 4, or 1 to about 2 carbon atoms in the alcohol-derived portion of the ester). The epoxide includes an aliphatic epoxide or a styrene oxide. Examples of useful epoxides include ethylene oxide, propylene oxide, butene oxide, octene oxide, dodecene oxide, styrene oxide and the like. In one embodiment the epoxide is propylene oxide. Suitable examples of the glycols include aliphatic glycols having 1 to about 12, or about 2 to about 6, or about 2 to about 3 carbon atoms. The dithiophosphoric acids, glycols, epoxides, inorganic phosphorus reagents and methods of reacting the same are described in U.S. Pat. Nos. 3,197,405 and 3,544,465. The resulting acids may then be salted with amines. An example of suitable dithiophosphoric acid derivative is prepared by adding phosphorus pentoxide (about 64 grams) at about 58° C. over a period of about 45 minutes to about 514 grams of hydroxypropyl O,O-di(4-methyl-2-pentyl)phosphorodithioate (prepared by reacting di(4-methyl-2-pentyl)-phosphorodithioic acid with about 1.3 moles of propylene oxide at about 25° C.). The mixture is heated at about 75° C. for about 2.5 hours, mixed with a diatomaceous earth and filtered at about 70° C. The filtrate contains about 11.8% by weight phosphorus, about 15.2% by weight sulphur, and an acid number of 87 (bromophenol blue).

In one embodiment the phosphorus-containing acid, salt or ester includes a non-ionic phosphorus compound. Typically the non-ionic phosphorus compound may have an oxidation of +3 or +5. The different embodiments include phosphite ester, phosphate esters, or mixtures thereof. A more detailed description of the non-ionic phosphorus compound include column 9, line 48 to column 11, line 8 of U.S. Pat. No. 6,103,673.

In one embodiment the phosphorus-containing acid, salt or ester includes an amine salt of at least one partially esterified monothiophosphoric acid, or mixtures thereof.

In one embodiment the phosphorus-containing acid, salt or ester includes an amine salt of at least one partial ester of phosphoric acid.

A more detailed description of the amine salt of at least one partial ester of monothiophosphoric acid; and the amine salt of at least one partial ester of phosphoric acid is disclosed in EP 460 317.

In one embodiment the phosphorus-containing acid, salt or ester is present in the lubricating composition at a range selected from the group consisting of about 0 wt % to about 20 wt %, about 0.01 wt % to about 15 wt %, or about 0.1 wt % to about 10 wt %, or about 0.1 wt % to about 7.5 wt %, and about 0.1 wt % to about 5 wt %, of the lubricating composition.

Extreme Pressure Agent

The extreme pressure agent is typically other than the phosphorus-containing acid, salt, or ester.

The extreme pressure agent includes a boron-containing compound, a sulphur-containing compound, or mixtures thereof.

In one embodiment the extreme pressure agent includes a boron-containing compound, or mixtures thereof.

In one embodiment the extreme pressure agent includes a sulphur-containing compound, or mixtures thereof.

In one embodiment the extreme pressure agent includes a sulphur-containing compound and a boron-containing compound.

In one embodiment the extreme pressure agent is present in the lubricating composition at a range selected from the group consisting of about 0 wt % to about 20 wt %, about 0.01 wt % to about 15 wt %, or about 0.1 wt % to about 10 wt %, or about 0.1 wt % to about 7.5 wt %, and about 0.1 wt % to about 5 wt %, of the lubricating composition.

Sulphur-Containing Compound

In one embodiment the extreme pressure agent includes a sulphur-containing compound. In one embodiment the sulphur-containing compound includes a sulphurised olefin, a polysulphide, or mixtures thereof.

Examples of the sulphurised olefin include an olefin derived from propylene, isobutylene, pentene, an organic sulphide and/or polysulphide including benzyldisulphide; bis- (chlorobenzyl)disulphide; dibutyl tetrasulphide; di-tertiary butyl polysulphide; and sulphurised methyl ester of oleic acid, a sulphurised alkylphenol, a sulphurised dipentene, a sulphurised terpene, a sulphurised Diels-Alder adduct, an alkyl sulphenyl N'N-dialkyl dithiocarbamates; or mixtures thereof. In one embodiment the sulphurised olefin includes an olefin derived from propylene, isobutylene, pentene or mixtures thereof.

In one embodiment the extreme pressure agent sulphur-containing compound including a dimercaptothiadiazole compound, or mixtures thereof. Examples of the dimercaptothiadiazole compound include 2,5-dimercapto-1,3-4-thiadiazole or a hydrocarbyl-substituted 2,5-dimercapto-1,3-4-thiadiazole, or oligomers thereof. The oligomers of hydrocarbyl-substituted 2,5-dimercapto-1,3-4-thiadiazole typically form by forming a sulphur-sulphur bond between 2,5-dimercapto-1,3-4-thiadiazole units to form oligomers of two or more of said thiadiazole units. Suitable 2,5-dimercapto-1,3-4-thiadiazole compounds include 2,5-bis(tert-nonyldithio)-1,3,4-thiadiazole or 2-tert-nonyldithio-5-mercapto-1,3,4-thiadiazole.

The number of carbon atoms on the hydrocarbyl substituents of the hydrocarbyl-substituted 2,5-dimercapto-1,3-4-thiadiazole typically include about 1 to about 30, or about 2 to about 20, or about 3 to about 16.

Borate Ester or Borate Alcohol

In one embodiment the extreme pressure agent includes a boron-containing compound. The boron-containing compound includes a borate ester, a borate alcohol, or mixtures thereof.

In one embodiment the boron-containing compound includes a borate ester or a borate alcohol. The borate ester or borate alcohol compounds are substantially the same except the borate alcohol has at least one hydroxyl group that is not esterified. Therefore, as used herein the term "borate ester" is used to refer to either borate ester or borate alcohol.

The borate ester may be prepared by the reaction of a boron compound and at least one compound selected from epoxy compounds, halohydrin compounds, epihalohydrin compounds, alcohols and mixtures thereof. The alcohols include dihydric alcohols, trihydric alcohols or higher alcohols, with the proviso for one embodiment that hydroxyl groups are on adjacent carbon atoms i.e. vicinal. Hereinafter "epoxy compounds" is used when referring to "at least one compound selected from epoxy compounds, halohydrin compounds, epihalohydrin compounds and mixtures thereof."

Boron compounds suitable for preparing the borate ester include the various forms selected from the group consisting of boric acid (including metaboric acid, $HBO_2$, orthoboric acid, $H_3BO_3$, and tetraboric acid, $H_2B_4O_7$), boric oxide, boron trioxide and alkyl borates. The borate ester may also be prepared from boron halides.

In one embodiment the borate ester is formed by the reaction of a borating agent with an epoxy compound, dihydric alcohols, trihydric alcohols or higher alcohols.

The borating agent includes various forms of boric acid (including metaboric acid, $HBO_2$, orthoboric acid, $H_3BO_3$, and tetraboric acid, $H_2B_4O_7$), boric oxide, boron trioxide, and alkyl borates, such as those of the formula $(RO)_xB(OH)_y$ wherein x is 1 to 3 and y is 0 to 2, the sum of x and y being 3, and where R is a hydrocarbyl group containing about 1 or more carbon atoms, provided that the borating agent is soluble in the polyoxyalkylene polyol.

In one embodiment, the borating agent includes an alkali or mixed alkali metal and alkaline earth metal borate. These metal borates are generally hydrated particulate metal borates which are known in the art. In one embodiment the metal borates include mixed alkali and alkaline earth metal borates. These metal borates are available commercially.

In one embodiment x is equal to 2 or 3 for the formula $(RO)_xB(OH)_y$. When x is equal to 2 or 3, at least two of the R groups per the above formula are hydrocarbyl groups. The hydrocarbyl groups include alkyl, aryl or cycloalkyl when any two adjacent R groups are connected in a ring. When R is alkyl, the group include saturated or unsaturated. In one embodiment the hydrocarbyl group is an unsaturated alkyl. In one embodiment the hydrocarbyl group is cyclic. In one embodiment the hydrocarbyl groups are mixtures of alkyl and cycloalkyl.

Generally there is no upper limit on the number of carbon atoms in the molecule, but a practical limit includes about 500, or about 400, or about 200, or about 100, or about 60. For example, the number of carbon atoms present in each R group includes about 1 to about 60, or about 1 to about 40, or about 1 to about 30 carbon atoms, provided the total number of carbon atoms on the R groups typically ranges from in about 9 or more, or about 10 or more, or about 12 or more, or about 14 or more.

In one embodiment all R groups are hydrocarbyl groups containing about 1 to about 30 carbon atoms, provided the total number of carbon atoms is about 9 or more.

Examples of R groups include isopropyl, n-butyl, isobutyl, amyl, 2-pentenyl, 4-methyl-2-pentyl, 2-ethylhexyl, heptyl, isooctyl, nonyl, decyl, undecyl, dodecenyl, dodecyl, tridecyl, tetradecyl, pentadecyl, hexadecyl, heptadecyl, octadecyl, octadecenyl (commonly referred to as oleyl), nonadecyl and eicosyl groups.

In one embodiment the epoxy compounds of the invention include commercial mixtures of $C_{14}$-$C_{16}$ epoxides or $C_{14}$-$C_{18}$ epoxides. In one embodiment, the epoxy compounds of the invention have been pure. Examples of suitable pure epoxy compounds may include 1,2-epoxydecane, 1,2-epoxyundecane, 1,2-epoxydodecane, 1,2-epoxytridecane, 1,2-epoxybutadecane, 1,2-epoxypentadecane 1,2-epoxyhexadecane, 1,2-epoxyheptadecane, 1,2-epoxyoctadecane, 1,2-epoxynonadecane and 1,2-epoxyicosane. In one embodiment pure epoxy compounds include 1,2-epoxytetradecane, 1,2-epoxypentadecane 1,2-epoxyhexadecane, 1,2-epoxyheptadecane, 1,2-epoxyoctadecane. In one embodiment purified epoxy compounds include 1,2-epoxyhexadecane.

The dihydric alcohols, trihydric alcohols or higher alcohols may contain about 2 to about 30, or about 4 to about 26, or about 6 to about 20 carbon atoms. The alcohol compounds may include glycerol compounds, such as, glycerol monooleate.

The borate ester may be prepared by blending the borating agent and the epoxy compounds or alcohols described above and heating them at a suitable temperature, such as at about 80° C. to about 250° C., about 90° C. to about 240° C., or about 100° C. to about 230° C., until the desired reaction has occurred. The molar ratio of the borating agent to the epoxy compounds includes about 4:1 to about 1:4, or about 1:1 to about 1:3, or about 1:2. An inert liquid may be used in performing the reaction. The liquid includes toluene, xylene, chlorobenzene, dimethylformamide, or mixtures thereof. Water is typically formed and is distilled off during the reaction. Alkaline reagents may be used to catalyze the reaction.

In one embodiment suitable boron-containing compounds include tripropyl borate, tributyl borate, tripentyl borate, trihexyl borate, triheptyl borate, trioctyl borate, trinonyl borate and tridecyl borate.

In one embodiment the borate ester compounds include tributyl borate, tri-2-ethylhexyl borate or mixtures thereof.

Conventional Oil of Lubricating Viscosity

In one embodiment the hydrocarbyl-capped polyoxyalkylene polyol disclosed herein, is mixed with a conventional oil of lubricating viscosity. For instance where a conventional oil of lubricating viscosity may be immiscible with the hydrocarbyl-capped polyoxyalkylene polyol disclosed herein, a person skilled in the art may further include ester base oils. The presence of ester base oils without being bound by theory is believed to aid in solubilising hydrocarbyl-capped polyoxyalkylene polyol disclosed herein, and a conventional oil of lubricating viscosity.

In one embodiment the lubricating compositions of the present invention are lubricated with the hydrocarbyl-capped polyoxyalkylene polyol as disclosed herein i.e. the lubricating composition is free of a conventional oil of lubricating viscosity, other than diluent oil conventionally associated with lubricant additives.

The conventional oil of lubricating viscosity is an oil other than the hydrocarbyl-capped polyoxyalkylene polyol as disclosed herein. The conventional oil of lubricating viscosity includes natural and synthetic oils, oil derived from hydrocracking, hydrogenation, and hydrofinishing, unrefined, refined and re-refined oils or mixtures thereof.

Unrefined oils are those obtained directly from a natural or synthetic source generally without (or with little) further purification treatment.

Refined oils are similar to the unrefined oils except they have been further treated in one or more purification steps to improve one or more properties. Purification techniques are known in the art and include solvent extraction, secondary distillation, acid or base extraction, filtration, percolation and the like.

Re-refined oils are also known as reclaimed or reprocessed oils, and are obtained by processes similar to those used to obtain refined oils and often are additionally processed by techniques directed to removal of spent additives and oil breakdown products.

Natural oils useful in making the conventional oil of lubricating viscosity include animal oils, vegetable oils (e.g., castor oil, lard oil), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic conventional oils of lubricating viscosity are useful and include hydrocarbon oils such as polymerised and interpolymerised olefins (e.g., polybutylenes, polypropylenes, propylene-isobutylene copolymers); poly(1-hexenes), poly(1-octenes), poly(1-decenes), and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); alkylated diphenyl ethers and alkylated diphenyl sulphides and the derivatives, analogs and homologs thereof or mixtures thereof.

Another synthetic conventional oil of lubricating viscosity include polyol esters other than the hydrocarbyl-capped polyoxyalkylene polyol as disclosed herein, diesters, liquid esters of phosphorus-containing acids (e.g., tricresyl phosphate, trioctyl phosphate, and the diethyl ester of decane phosphonic acid), or polymeric tetrahydrofurans. Synthetic conventional oil of lubricating viscosity also include those produced by Fischer-Tropsch reactions and typically may be hydroisomerised Fischer-Tropsch hydrocarbons or waxes. In one embodiment conventional oil of lubricating viscosity may be prepared by a Fischer-Tropsch gas-to-liquid synthetic procedure as well as other gas-to-liquid oils.

In one embodiment the lubricating composition is a multigrade fluid.

Conventional oils of lubricating viscosity may also be defined as specified in the American Petroleum Institute (API) Base Oil Interchangeability Guidelines. The five base oil groups are as follows: Group I (sulphur content >0.03 wt %, and/or <90 wt % saturates, viscosity index 80-120); Group II (sulphur content ≤0.03 wt %, and ≥90 wt % saturates, viscosity index 80-120); Group III (sulphur content ≤0.03 wt %, and ≥90 wt % saturates, viscosity index ≥120); Group IV (all polyalphaolefins (PAOs)); and Group V (all others not included in Groups I, II, III, or IV). The oil of lubricating viscosity comprises an API Group I, Group II, Group III, Group IV, Group V oil or mixtures thereof. Often the oil of lubricating viscosity is an API Group I, Group II, Group III, Group IV oil or mixtures thereof. Alternatively the oil of lubricating viscosity is often an API Group II, Group III or Group IV oil or mixtures thereof.

Other Performance Additive

The lubricating composition of the invention optionally further includes at least one other performance additive. The other performance additives include metal deactivators, detergents, dispersants, antioxidants, corrosion inhibitors, foam inhibitors, demulsifiers, pour point depressants, seal swelling agents, or mixtures thereof.

In one embodiment the total combined amount of the other performance additive compounds present on an oil free basis is present in the lubricating composition at a range selected from the group consisting of 0 wt % to 25 wt %, or 0.01 wt % to 10 wt %, or 0.01 wt % to 10 wt % or 0.01 wt % to 10 wt %, and 0.01 to 5 wt %, of the lubricating composition. Although one or more of the other performance additives may be present, it is common for the other performance additives to be present in different amounts relative to each other.

Antioxidants include molybdenum compounds such as molybdenum dithiocarbamates, sulphurised olefins, hindered phenols, aminic compounds such as alkylated diphenylamines (typically di-nonyl diphenylamine, octyl diphenylamine, or di-octyl diphenylamine); detergents include neutral or overbased detergents, Newtonian or non-Newtonian, basic salts of alkali, alkaline earth or transition metals with one or more of a phenate, a sulphurised phonate, a sulphonate, a carboxylic acid, a phosphorus acid, a mono- and/or a dithiophosphoric acid, a saligenin, an alkylsalicylate, and a salixarate; and dispersants include N-substituted long chain alkenyl succinimides, as well as Mannich condensation products as well as post-treated versions thereof. Post-treated dispersants include those by reaction with urea, thiourea, dimercaptothiadiazoles, carbon disulphide, aldehydes, ketones, carboxylic acids, hydrocarbon-substituted succinic anhydrides, nitriles, epoxides, and phosphorus compounds.

Additionally the invention may also include friction modifiers other than component including fatty amines, esters such as borated glycerol esters, fatty glycerol partial esters (for example glycerol mono-oleate, or glycerol di-oleate), fatty phosphites, fatty acid amides, fatty epoxides, borated fatty epoxides, alkoxylated fatty amines, borated alkoxylated fatty amines, metal salts of fatty acids, or fatty imidazolines, condensation products of carboxylic acids and polyalkylene-polyamines.

Other performance additives such as corrosion inhibitors including octylamine octanoate, condensation products of dodecenyl succinic acid or anhydride and a fatty acid such as oleic acid with a polyamine; metal deactivators including derivatives of benzotriazoles (typically tolyltriazole), 1,2,4-triazoles, benzimidazoles, 2-alkyldithiobenzimidazoles or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides; and seal swell agents including Exxon Necton-37™ (FN 1380) and Exxon Mineral Seal Oil (FN 3200); and dispersant viscosity modifiers (often referred to as DVM) include functionalised polyolefins, for example, ethylene-propylene copolymers that have been functionalized with the reaction product of maleic anhydride and an amine, a polymethacrylate functionalised with an amine, or ester of maleic anhydride-styrene copolymers reacted with an amine; may also be used in the composition of the invention.

INDUSTRIAL APPLICATION

The method of the invention is useful for lubricating a variety of mechanical devices. The mechanical device comprises at least one of an internal combustion engine (for crankcase lubrication), a hydraulic system, an axle, a gear, a gearbox or a transmission. In one embodiment the mechanical devices includes a driveline device such as an axle, a gear, a gearbox or a transmission.

The transmission may include manual transmissions, continuously variable transmissions (CVT), infinitely variable transmissions (IVT), Toroidal transmissions, continuously slipping torque converted clutches (CSTCC), automatic transmissions, stepped automatic transmissions, traction drive transmissions or dual clutch transmissions (DVT). In one embodiment the transmission is a manual transmission.

In one embodiment the lubricating composition disclosed herein is capable of providing the mechanical device with an oil of lubricating viscosity capable of imparting at least one of an acceptable co-efficient of friction, viscosity index (VI), oil blend thickening capabilities, shear stability, good low temperature viscosity performance, reduced operating temperatures, acceptable wear performance, acceptable durability, or acceptable fuel economy.

The following examples provide illustrations of the invention. These examples are non exhaustive and are not intended to limit the scope of the invention.

EXAMPLES

As quoted herein, the amount of additives added to the examples below includes conventional amounts of diluent (may be 0 wt % to about 60 wt % depending on additive).

Example 1 is a gear oil containing 10 wt % of a commercially available additive package and about 90 wt % of a $C_{12-15}$-alkyl alcohol-initiated polyalkylene glycol derived from propylene glycol (commercially available from Bayer with the trade name Actaclear™ ND-21). The gear oil further contains about 5 wt % of a viscosity index improver (esters of maleic anhydride-styrene copolymers), about 4.6 wt % of a sulphurised olefin, about 1.9 wt % of phosphorus antiwear agents, about 3.25 wt % of antioxidants (includes phenolic and aminic compounds).

Example 2 a gear oil containing 10 wt % of a commercially available additive package and about 90 wt % of a commercially available butanol-initiated polyalkylene glycol derived from propylene glycol. The gear oil further contains about 5 wt % of a viscosity index improver (esters of maleic anhydride-styrene copolymers), about 4.6 wt % of a sulphurised olefin, about 1.9 wt % of phosphorus antiwear agents, about 3.25 wt % of antioxidants (includes phenolic and aminic compounds).

Example 3 is a gear oil similar to Example 1, except the viscosity modifier is present at about 10 wt %.

Comparative Example 1 is the same as Example 1 except the viscosity modifier is a polyolefin copolymer. The polyolefin copolymer viscosity modifier does not solubilise in the lubricating composition.

Comparative Example 2 is similar to Example 3, except the viscosity index improver is not present.

Test 1: Axle Efficiency

The axle efficiency of Reference Example 1 and Example 1 is determined by employing the methodology disclosed in SAE Paper No. 2003-01-3235 (entitled: "Developing Next Generation Axle Fluids: Part III—Laboratory CAFE Simulation Test as Key Fluid Development Tool", authors: Akucewich, E. S.; O'Connor, B. M.; Vinci, J. N.; Schenkenberger, C.). The test method simulates the Federal Test Procedure 75 (FTP-75). The method simulates FTP-75 by performing a series of steady-state speed and load conditions in a laboratory full-scale axle stand. The test method employs a single axle for multiple lubricant evaluations. In order to minimize drift in efficiency performance associated with a new axle, a break-in procedure is conducted on the axle before the testing commences. Following the break-in procedure, the examples are evaluated twice. The results obtained are:

| | Run 1 | Run 2 |
|---|---|---|
| Example 1 | 95.14 | 95.17 |
| Example 2 | 94.18 | 94.13 |

Test 2: Coefficient of Friction

The example compositions disclosed above are evaluated for coefficient of friction using a Mini Traction Machine (MTM) available from PCS Instruments. The test configuration is that of about 19.05 mm (¾ inch) diameter bearing steel ball making a contact on a highly polished surface on a 46 mm diameter bearing steel disk. Ball makes contact with the disc such that spin in the contact is eliminated. Rolling velocity, slide/roll ratio, temperature and load, were the parameters that could be varied during each test. The specimen speeds are independently controlled using servo-motors to produce desired slide/roll motion at the contact. The specimens are contained in a sealed temperature controlled reservoir that contains an approximately 35 ml fluid sample. The test temperature is controlled through the use of electric heaters. The contact is automatically loaded to the desired Hertz pressure. The series of tests that were run for this particular study were carried out at a Hertz pressure of about 1.25 GPa, temperature range of about 40° C. to about 120° C., rolling velocity of about 2.5 m/s and continuously variable slide to roll ratios from about 0% to about 30%. The results obtained are:

| | Adjusted SRR (Slide to Roll Ratio) | | |
|---|---|---|---|
| Example | 10 | 20 | 30 |
| Example 1 | 0.010 | 0.014 | 0.016 |
| Example 2 | 0.010 | 0.014 | 0.016 |

Test 3: Viscosity Measurement

The Kinematic and Brookfield viscosities are determined employing ASTM methods D445 at about 100° C. (KV100) and D2983 at about −40° C. (BV −40) respectively. The viscosity index (VI) is also determined by employing the ASTM method D2270. The data obtained is:

| Example | BV-40 | KV100 | (VI) |
|---|---|---|---|
| Comparative Example 2 | 83.52 | 14.76 | 186 |
| Example 3 | 130.26 | 21.64 | 194 |

Overall the data obtained demonstrates that the lubricating composition of the invention is capable of providing a multi-grade lubricant. In addition, the lubricating composition of the invention is capable of providing the mechanical device with at least one of acceptable low temperature viscometrics, acceptable high temperature viscometrics, viscosity index (VI), oil blend thickening capabilities, shear stability, an acceptable co-efficient of friction, reduced operating temperatures, acceptable wear performance, acceptable corrosion, acceptable oxidative degradation, acceptable durability, or acceptable fuel economy.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

While the invention has been explained in relation to its various embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition comprising:

(a) about 5 wt % to about 10 wt % of an ester-containing viscosity index improver wherein the ester-containing viscosity index improver comprises an esterified maleic anhydride-styrene copolymer, each ester group of the ester-containing viscosity index improver contains about 8 to about 14 carbon atoms, and the copolymer has a reduced specific viscosity of about 0.06 to about 0.8;

(b) about 90 wt % to about 98.29 wt % of a polyoxyalkylene polyol, wherein the polyoxyalkylene polyol comprises (i) a portion of oxyalkylene groups derived from ethylene oxide; and (ii) a portion of oxyalkylene groups derived from an alkylene oxide containing about 3 to about 8 carbon atoms, and the polyoxyalkylene polyol has a weight average molecular weight of about 1000 to about 5000;

(c) about 0.1 wt % to about 5 wt % of a phosphorus-containing acid, salt or ester;

(d) about 0.1 wt % to about 5 wt % of a non-phosphorus extreme pressure agent; and (e) about 0.01 wt % to about 5 wt % of at least one other performance additive, wherein the lubricating composition is a multi-grade fluid.

2. The lubricating composition of claim 1, wherein the polyoxyalkylene polyol is a copolymer of ethylene oxide and propylene oxide.

3. The lubricating composition of claim 1, wherein the phosphorus-containing acid, salt or ester is selected from the group consisting of (i) a non-ionic phosphorus compound; (ii) an amine salt of a phosphorus compound; (iii) an ammonium salt of a phosphorus compound; (iv) a mono- or divalent metal salt of a phosphorus compound, such as a metal dialkyldithiophosphate or a metal dialkylphosphate; and (v) mixtures of two or more of (i), (ii), (iii) or (iv).

4. The lubricating composition of claim 1, wherein the on-phosphorus extreme pressure agent comprises at least one of a boron-containing compound, a sulphur-containing compound, or mixtures thereof.

5. A method of lubricating a mechanical device by supplying to the mechanical device a lubricating composition of claim 1, wherein the mechanical device is a driveline device.

6. The method of claim 5, wherein the driveline device is selected from at least of the group consisting of an axle, a gear, a gearbox and a transmission.

7. The method of claim 6, wherein the transmission is selected from at least of the group consisting of manual transmissions, continuously variable transmissions, infinitely variable transmissions, toroidal transmissions, continuously slipping torque converted clutches, automatic transmissions, stepped automatic transmissions, traction drive transmissions and dual clutch transmissions.

8. The lubricating composition of claim 1, wherein the polyoxyalkylene polyol comprises (i) about 0.1 wt % to about 80 wt % of ethylene oxide, and an alkylene oxide containing about 3 to about 8 carbon atoms present at about 20 wt % to about 99.9 wt % of the polyoxyalkylene polyol.

9. The lubricating composition of claim 1, wherein the polyoxyalkylene polyol comprises (i) about 1 wt % to about 70 wt % of ethylene oxide, and an alkylene oxide containing about 3 to about 8 carbon atoms present at about 30 wt % to about 99 wt % of the polyoxyalkylene polyol.

10. The lubricating composition of claim 1, wherein the polyoxyalkylene polyol comprises (i) about 5 wt % to about 60 wt % of ethylene oxide, and an alkylene oxide containing about 3 to about 8 carbon atoms present at about 40 wt % to about 95 wt % of the polyoxyalkylene polyol.

11. The lubricating composition of claim 1, wherein the alkylene oxide containing about 3 to about 8 carbon atoms is selected from the group consisting of propylene oxide, butylene oxide, pentylene oxide, hexylene oxide, heptylene oxide, and octylene oxide.

12. The method of claim 5, wherein the driveline device is an axle.

* * * * *